United States Patent [19]

Zadorozny

[11] 4,015,102

[45] Mar. 29, 1977

[54] APPARATUS FOR MAKING AN ELECTRIC CONDUCTOR

[75] Inventor: Peter Zadorozny, Cumberland, R.I.

[73] Assignee: Owens-Corning Fiberglas Corporation, Toledo, Ohio

[22] Filed: May 1, 1975

[21] Appl. No.: 573,493

[52] U.S. Cl. ..... 219/155; 29/593; 219/470; 242/154; 427/101

[51] Int. Cl.[2] ..... C21D 9/62

[58] Field of Search ..... 219/155, 469, 470, 471; 29/593; 427/101, 58; 156/53, 9, 876; 242/154, 153, 147 R, 75 B

[56] References Cited

UNITED STATES PATENTS

| | | | |
|---|---|---|---|
| 717,274 | 12/1902 | Reardon | 242/154 |
| 1,998,453 | 4/1935 | Foster et al. | 242/75.3 |
| 2,570,773 | 10/1951 | Davis | 242/147 R |
| 3,700,933 | 10/1972 | Harkenrider | 219/10.77 UX |
| 3,710,062 | 1/1973 | Peters | 219/10.49 |
| 3,761,667 | 9/1973 | Walden | 219/10.49 |
| 3,770,928 | 11/1973 | Kornrumpf | 219/10.49 |
| 3,786,219 | 1/1974 | Kornrumpf | 219/10.49 |
| 3,890,179 | 6/1975 | Dearduff | 156/53 |

*Primary Examiner*—E. A. Goldberg
*Attorney, Agent, or Firm*—John W. Overman; Kenneth H. Wetmore; Ronald C. Hudgens

[57] ABSTRACT

An apparatus for controlling the electrical resistance in a moving electrical conductor during its production. The apparatus including means for conducting a current along a predetermined constant length of the thermally cured conductor, means for measuring the voltage across the predetermined length, means for comparing the voltage drop with the desired voltage drop and means for varying the extent of thermal curing of the conductor when the voltage drop measured varies from that desired. There is also provided a tension control device for the conductor in the apparatus.

9 Claims, 24 Drawing Figures

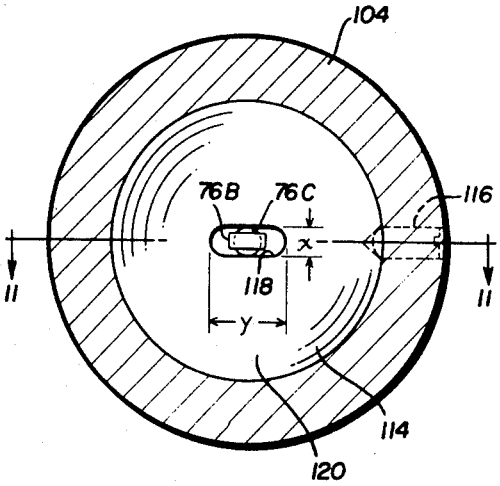
FIG. 10
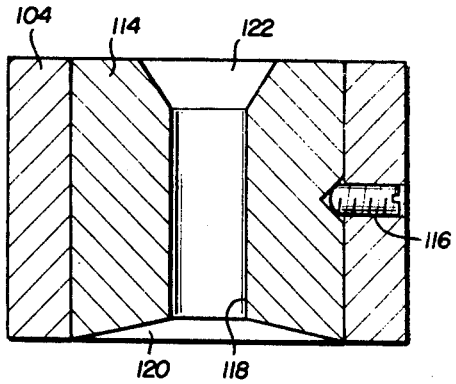
FIG. 11
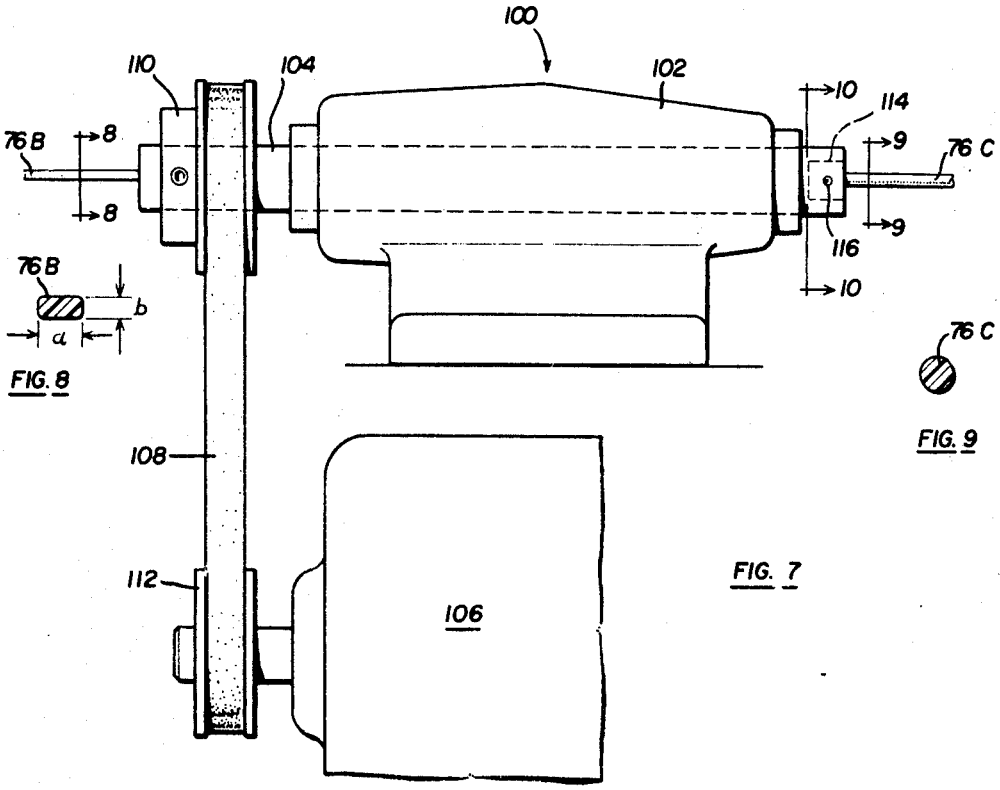
FIG. 8
FIG. 9
FIG. 7

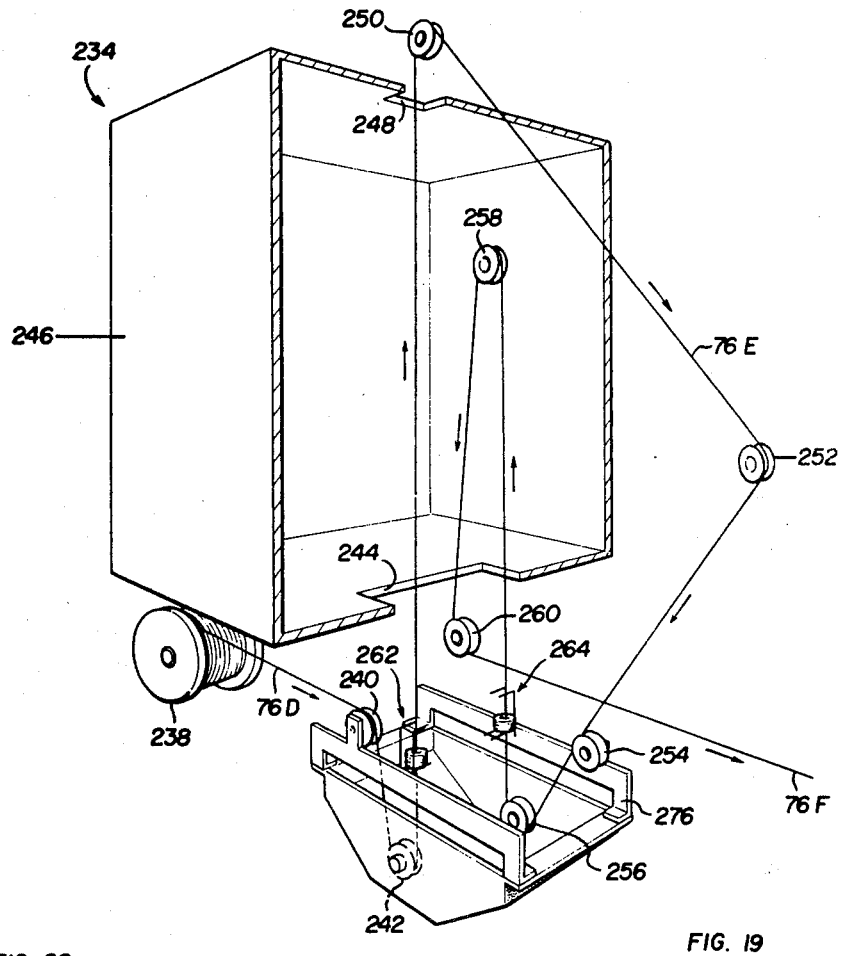
FIG. 19
FIG. 20
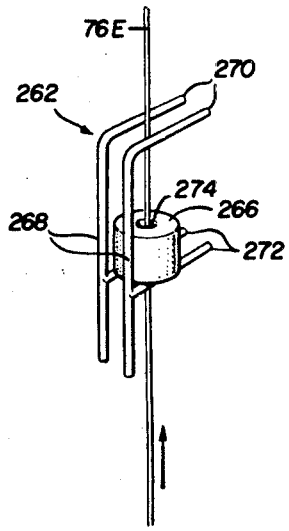
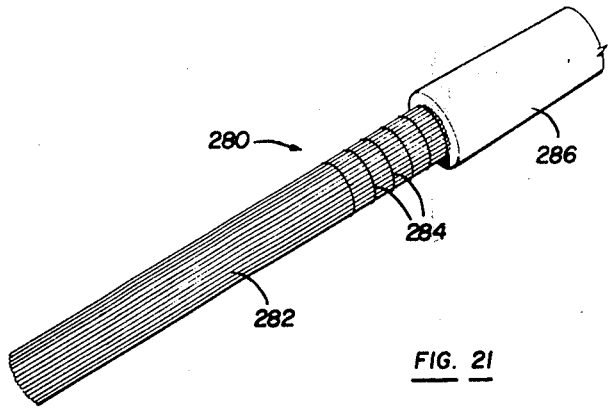
FIG. 21

APPARATUS FOR MAKING AN ELECTRIC CONDUCTOR

FIELD OF THE INVENTION

The conductor made by the apparatus of this invention is particularly suitable for high temperature and service applications which require uniform conductance, such as an automotive spark ignition cable. The apparatus for making an electric conductor of this invention permits the use of a continuous high speed line and results in an improved product which has uniform electrical resistance. U.S. Pat. No. 3,247,020 of Shulver et al, assigned to the Assignee of the instant application, describes a method of applying an electrically-conductive coating to the outer surface of glass fibers. In the method disclosed in the Shulver patent, the ends of glass strands are collected from a creel, dipped in a thermally curable liquid dispersion of electrically conductive particles and cured on a heated drum. The Shulver patent discloses various conductive coatings and suitable compositions for the liquid dispersion and is incorporated herein by reference. The conductive roving is then collected in the Shulver patent on a take-up roll or reel. The apparatus of this invention is particularly adapted to improving that disclosed in the Shulver patent.

Further, as disclosed in U.S. Pat. No. 3,818,412 assigned to the Assignee of the instant application and incorporated herein by reference, the problems of electrical interference with communications has resulted in certain government standards applicable to automotive ignition cables and the like. For example, the temperature within an automobile hood has increased steadily, due to larger horsepower engines and emission control devices, requiring greater temperature service capabilities for all engine components, including ignition cables. These requirements have created an urgent need for ignition cables and the like having high temperature service capabilities and a uniform conductance and resistance throughout its length, which are met by the electrical conductor made by the apparatus of the present invention.

SUMMARY OF THE INVENTION

The apparatus of this invention is particularly adapted to produce an electrical conductor having uniform resistance along its length and uniform conductance between the core and a semi-conductive overcoat. The conductor includes an electrically conductive core comprised of a bundle of electrically conductive glass fibers. The conductive core is retained in a cylindrical bundle by an overwrap comprising one or more spirally wound elements, preferably of a non-conductive material, such as glass. Finally, the conductive core is encased in an overcoat, preferably of a semi-conductive material such as a suspension of conductive particles in polytetrafluoroethylene. The above referenced patent describes the advantages of the semi-conductive overcoat, including the elimination of stray radiation, the ease of stripping, temperature service capabilities and the preferred low coefficient of friction.

The apparatus disclosed herein optimizes the advantages of the conductor disclosed in the above referenced patent. The dimensions of the conductor are accurately controlled, including the diameter of the cylindrical core or roving and the semi-conductive overcoat. Uniform resistance is assured by constant monitoring and control during the process. Uniform conductance between the core and the overcoat is controlled by first impregnating the conductive roving and then encasing the roving and overwrap. For example, the apparatus of this invention may be used in the production of an electrical conductor having a uniform resistance of 4,000 ± 500 ohms per foot.

Specifically, the apparatus of this invention relates to the control of the electrical resistance of the conductor. As described, a primary object of the present invention is to produce a conductive roving having uniform resistance along its length within relatively narrow limits. The resistance of the filament bundle is continuously monitored and controlled by controlling the degree of curing with the apparatus of this invention.

In the preferred embodiment, the bundle of filaments are cured on heated drums having controllable heating elements located within the drums. The resistivity of the bundle is continuously monitored and the resistance is compared with a predetermined standard. If, for example, the resistance is greater than the predetermined standard or range, the temperature of the drums is increased, lowering the resistance of the filament bundle to within the accepted range. Alternatively, the resistance may be reduced by raising the temperature of the drums.

The resistance of the conductive filament bundle is monitored by continuously conducting a current along a predetermined length of the thermally cured bundle, continuously measuring the voltage drop across the predetermined length of filaments and continuously comparing the voltage drop with the desired standard. The extent of curing is then controlled where the voltage drop varies from the desired standard.

Other advantages and meritorious features of this invention will be more fully understood from the following description of the preferred methods and apparatus and the drawings, a description of which follows.

BRIEF DESCRIPTION OF THE DRAWINGS

FIG. 7 is a partial side elevation of a breaking station which may be used in the method of this invention;

FIG. 8 is a cross-sectional view of the conductive roving shown in FIG. 7 in the direction of view arrows 8—8;

FIG. 9 is a cross-sectional view of the conductive roving in the direction of view arrows 9—9 of FIG. 7;

FIG. 10 is a cross-sectional view of the breaker apparatus shown in FIG. 7, in the direction of view arrows 10—10;

FIG. 11 is a cross-sectional view of FIG. 10, in the direction of view arrows 11—11;

FIG. 19 is a perspective top elevation, partially schematic, of FIG. 18;

FIG. 20 is an enlarged view of a sizing and wiping die used in the apparatus of FIGS. 18 and 19;

FIG. 21 is a perspective end view of an electrical conductor formed by the method of this invention;

DESCRIPTION OF THE PREFERRED METHODS OF THIS INVENTION

Figure 1:
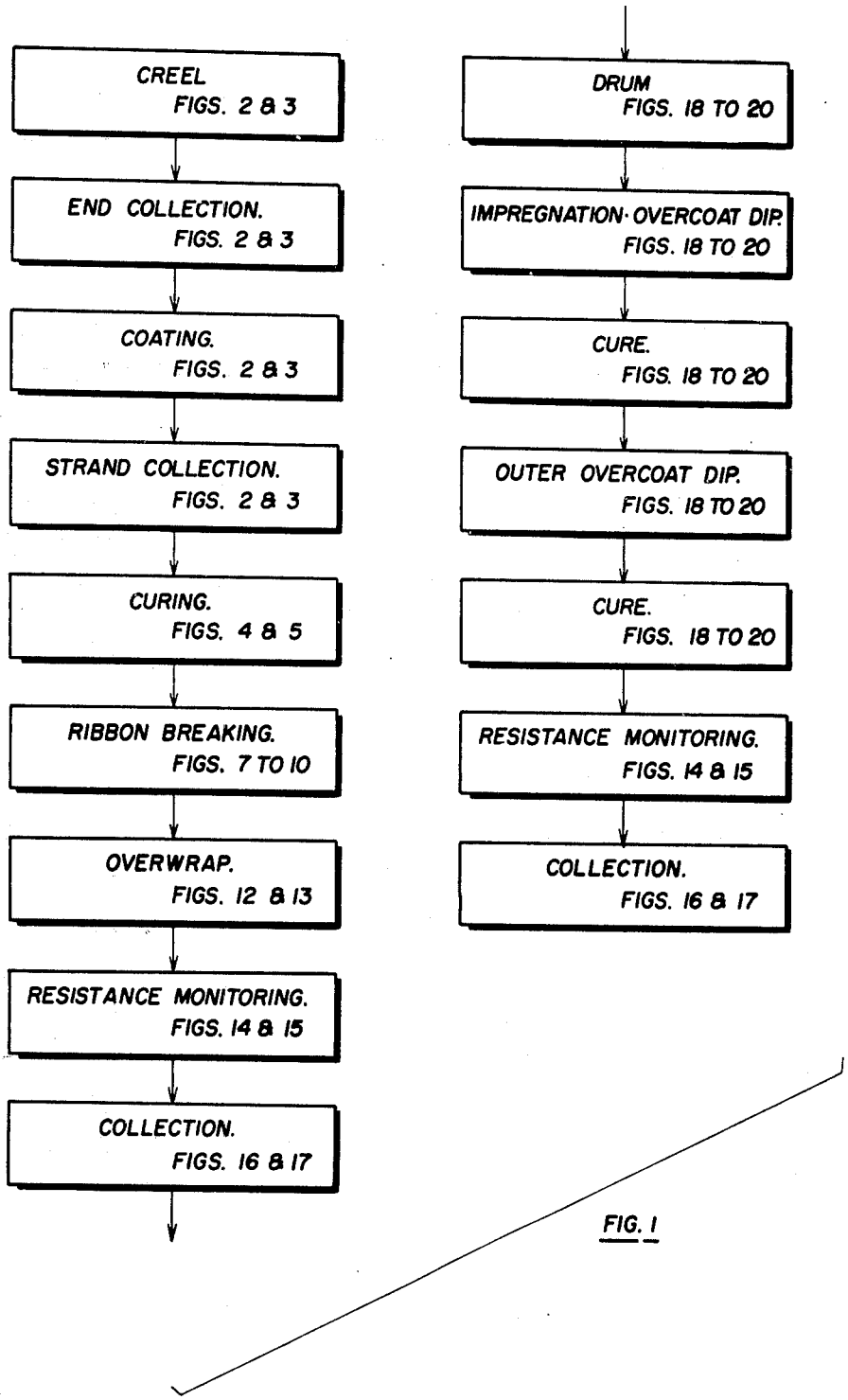
FIG. 1 is a flow chart showing one method of this invention for making an electrical conductor.

FIG. 1 illustrates one continuous method for making an electric conductor, wherein a plurality of glass strands are collected from a creel, coated with a thermally curable liquid dispersion of electrically conductive particles and cured, preferably on heated rotating drums, forming the electrically conductive roving or group of strands into a flattened ribbon. The ribbon may then be pulled through a breaker, which breaks the bond between the strands, reforming the ribbon into a cylindrical roving and applying a false twist to the roving. The roving is then bound in the cylindrical form with a spiral overwrap or the overwrap may be applied directly to the flattened ribbon which reforms the ribbon into the cylindrical roving. The electrical resistance of the overwrapped roving is preferably continuously monitored, which resistance is a function of the curing of the strand coating and therefore the temperature of the heated drums. An error signal may thus be produced at the monitoring station, which is used to control the temperature of the drums, thereby controlling the critical resistance of the electrical conductor formed by the method of this invention. Thus, the electrical resistance of the conductor may be accurately controlled within relatively narrow limits. The conductor may then be collected on a suitable drum in a collection station for later use.

The electrical conductor is then impregnated with an overcoat material, preferably a semi-conductive material such as a liquid dispersion of carbon particles in tetrafluoroethylene. The impregnated roving is then partially cured, dipped again in the overcoat material and finally cured. In the preferred method, the resistance of the semi-conductive overcoat material is monitored in a second resistance monitoring station and finally the electric conductor is collected on a drum or the like. The electrical resistance of the semi-conductive overcoat is a function of the percent of conductive particle, such as carbon, in the overcoat material and therefore the resistance may be controllable during the continuous operation by increasing or decreasing the percentage of conductive particles. The method steps shown in the flow chart of FIG. 1 refer to the Figures of this application wherein the method steps are disclosed in detail. As will be described herein, the method steps and apparatus of this invention may be combined and modified in various ways to make an electrical conductor or cable and FIG. 1 illustrates only one such combination.

Figure 2:
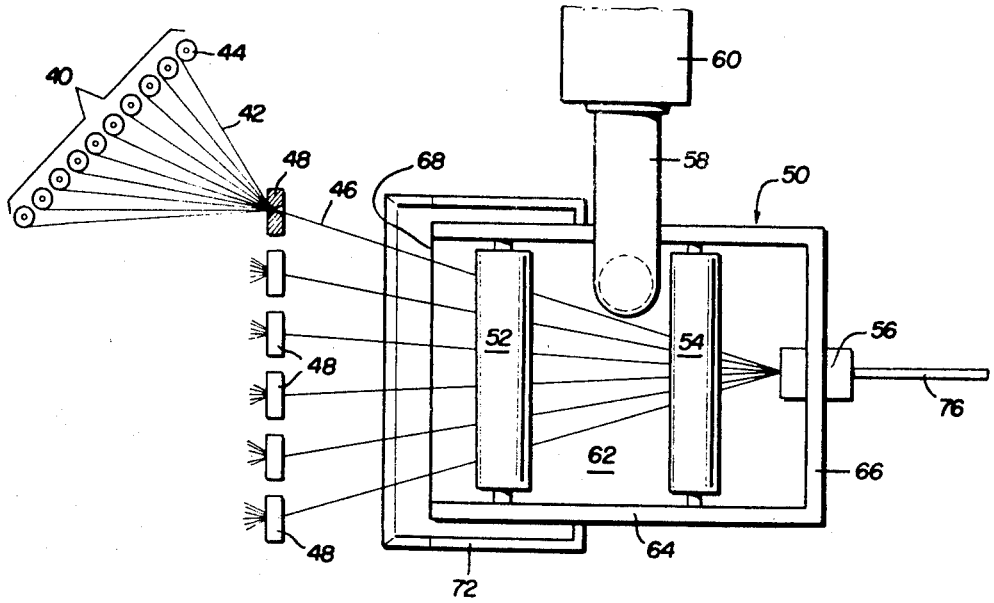
FIG. 2 is a top elevation, partially schematic, showing a dipping station for applying a thermally curable liquid dispersion of conductive particles to the roving.
Figure 3:
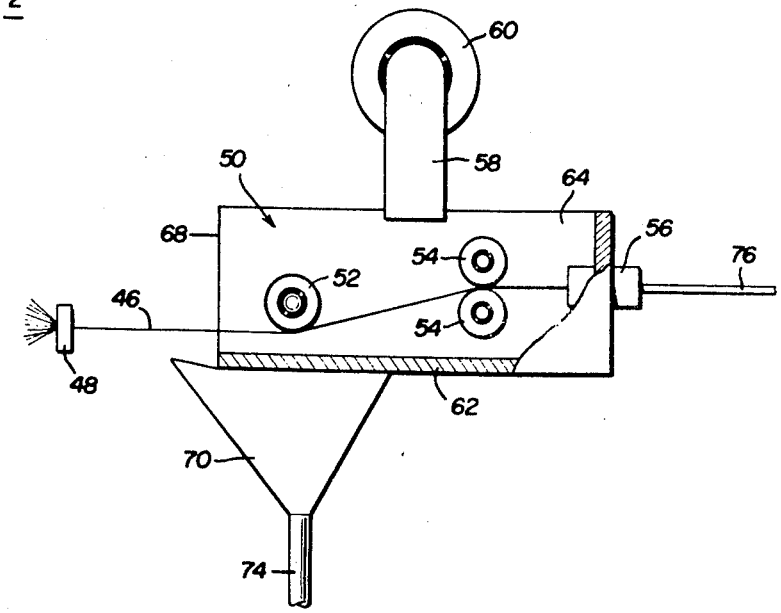
FIG. 3 is a side view, partially cross-sectioned, of a dipping station shown in FIG. 2.

FIGS. 2 and 3 illustrate one method of collecting and coating the glass strands utilized in the method of this invention. The method of this invention is particularly concerned with the manufacture of an electrical conductor having a cylindrical core or roving comprised of a plurality of glass strands which are initially non-conductive, such as described in the above referenced United States patent of Shulver et al. The strands may be formed of any suitable material, such as E Glass disclosed in U.S. Pat. No. 2,333,961, assigned to the Assignee of the instant application. A strand is defined for the purpose of this application as a bundle or plurality of glass filaments.

In FIG. 2, the strands 42 are collected from a creel 40 having a plurality of rolls 44. A suitable creel is disclosed in the above referenced United States patent of Shulver et al. A plurality of strands 42 are then collected in an eye 48. In the method of FIGS. 2 and 3, six sets of ten strands are collected in eyes 48 and dipped in a thermally curable liquid dispersion of conductive particles, as described. The non-conductive groups of strands 46 are then passed beneath dipping roller 52 in tank 50. The wetted strands are then passed between the pressure or squeeze rollers 54 and are finally collected in the form of a roving 76 in wiping die 56. In the disclosed method, a roving is a group of strands which forms the core of the electrical conductor. A roving may also be formed of a grouping or bundle of individual glass filaments.

The thermally curable liquid dispersion of conductive particles enters the tank 50 in the disclosed apparatus through inlet pipe 58 from reservoir 60. The tank includes a bottom wall 62, side walls 64 and one end wall 66. The tank end 68 is open to permit continuous flow of the liquid dispersion and prevent settling of the conductive particles. The liquid dispersion used in the dip tank 50 of FIGS. 2 and 3 is preferably relatively viscous, such that the liquid collects on the bottom of the tank and flows out of the open end 68 into a funnel-shaped trough or collector 70. The collector includes side walls 72 and a return line 74 to the reservoir 60. The flow of liquid is controlled such that the level is above the bottom of the dip roller 52 and below the level of the wiping die 56 and the level of the strands 46, between the pressure rollers 54. The wiping die has a predetermined size opening, wiping the excess of fluid from the roving 76, referred to herein as a roving and later as the core of the electrical conductor made by the method of this invention. A suitable size for the opening of the wiping die 56, wherein sixty strands are collected in the die, is 0.065 inches. The number of strands will of course depend upon the particular application for the conductor, however a suitable roving 76 has sixty glass strands, each strand having a diameter of about 0.005 inches. Various thermally curable liquid dispersions of conductive particles may also be utilized in the method of this invention, such as disclosed in the above referenced United States patent of Shulver et al. For example, a dispersion of particles of graphite in a water soluble thermosetting resin may be used having 7 to 12% by weight solids, preferably graphite. The resin serves as a binder for the graphite particles and adheres to the strands. As described in the Shulver et al patent, the coating may be carbonizable, pyrolizable or caramelizable. As used herein, a thermally curable liquid dispersion of conductive particles refers to a liquid which may be cured to provide an electrically conductive roving as described in the Shulver patent. One preferred method of drying the roving 76 and forming the electrically conductive core is disclosed in FIGS. 4 and 5.

Figure 5:
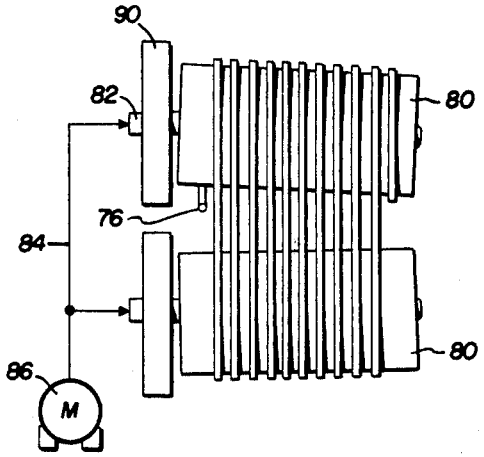
FIG. 5 is a side elevation of FIG. 4, partially schematic.
Figure 4:
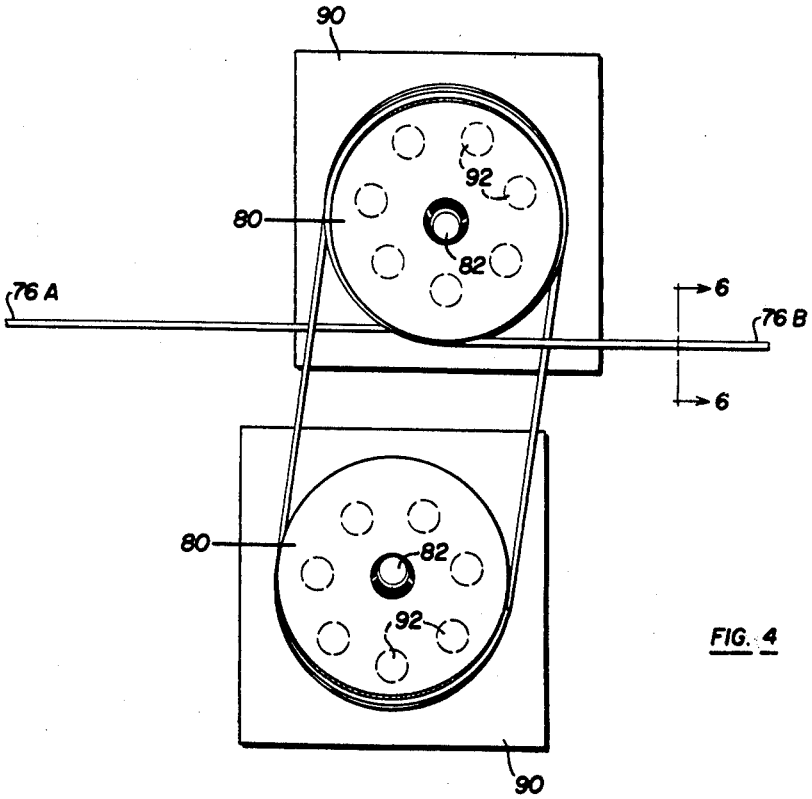
FIG. 4 is a side elevation of a curing station.

As shown in FIGS. 4 and 5, the roving 76 is initally generally cylindrical because the aperture in the wiping die 56 is cylindrical. The wetted roving is then tensioned about a pair of heated rotating drums 80. In FIG. 5, the roving takes ten passes over the drums. The drums 80 are supported for rotation on shafts 82 which are connected to motor 86 by a suitable drive means 84. The drive shafts 82 are supported in suitable support blocks 90.

The drums 80 in FIGS. 4 and 5 are electrically heated by "Chromalon" electric heater elements 92 which are enclosed heating elements, such as sold by E. L. Wiegand Division of Emerson Electric Company. Each of the drums in the disclosed embodiment includes seven heater elements which are individually controlled to heat the drums as described below. The roving is preferably tensioned around the drums, as shown in FIGS. 4 and 5 and the drums pull the roving through the dip tank 50 in FIGS. 2 and 3. The heated drums dry the roving and bake the electrically conductive coating. As described in the above referenced United States patent of Shulver et al, the coating applied in the dip tank 50 may be carbonizable, pyrolizable or caramelizable, wherein an increase in heat lowers the electrical resistance of the conductive roving. The electrical resistance of the roving may thereby be controlled by controlling the temperature of the heated drums as will be described hereinbelow. The temperature of the drums is normally maintained between about 650° and 1100° F.

Figure 6:
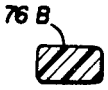
FIG. 6 is a cross-sectional view of the conductive roving of FIG. 4 in the direction of view arrows 6—6.

As described above, the conductive roving is preferably tensioned about the drums 80 and the rotating drums pull the roving through the dip tank. The tension in the roving thereby flattens the roving into a ribbon 76B as shown in FIG. 6. The flattening of the ribbon improves the thermal contact between the roving and the heated drums, reducing the required number of passes of the ribbon around the drums and therefore the time of curing. The roving is thereby worked into the flattened ribbon 76B shown in FIG. 6, however in the preferred embodiment of the electrical conductor made by the method of this invention, the conductive roving or core of the electrical conductor is cylindrical as described hereinbelow. As shown in FIG. 5, the rotational axis of the drums 80, as defined by the drive shafts 82, have converging axes, such that the tensioned roving normally slides sideways toward the end of the drums as the roving is pulled into the next station. By this method, the roving is received around the drums at one end and is removed after several passes from the opposed ends without requiring a guide means or the like. The drums may therefore have a smooth surface providing excellent thermal conductivity. One method of reforming the flattened ribbon of conductive fibers into a cylindrical roving is shown in FIGS. 7 to 11, which is referred to as the breaker stations.

The breaker assembly 100 includes a drive 102 having a driven shaft or spindle 104 interconnected to a motor 106 through belt 108 and pulleys 110 and 112. The spindle 104 includes a breaker insert 114 which rotates with the spindle and is secured thereto by a suitable set screw 116 or the like.

The breaker insert 114 includes a configured orifice or opening 118 which receives the flattened ribbon 76B and reforms the strands into a cylindrical roving as described below. The insert opening 118 includes a conical inlet 120 and a smaller diameter conical outlet 122, as shown in FIG. 11. The configured opening 118 of the insert 114 is preferably elongated, as shown in FIG. 10, having a width $x$ less than the width $a$ of the flattened ribbon, as shown in FIG. 8. The length $y$ of the opening is greater than the width $a$ of the ribbon. As shown, the width $x$ of the opening is greater than the thickness $b$ of the ribbon. In the example thus far described, the ribbon may have a width $a$ of 0.065 inches and a thickness of 0.041 inches. A suitable insert opening would then have a length $y$ of 0.125 inches and a width $x$ of 0.055 inches. The corner radiuses may be 0.025 inches for example.

As described above, the insert 114 rotates with the spindle 104 and the flattened ribbon is drawn through the opening 118 of the insert. The rotating orifice will thus break the bond between the individual strands and reform the strands into a cylindrical roving as shown at 76C in FIG. 9. Further, the elongated opening will apply a false twist to the roving, downstream of the breaker insert, closely packing the strands in the roving. The necessity of a breaker will then depend upon the strength of the bond between the individual strands, which is formed during the curing of the conductive coating upon the heated drums shown in FIGS. 4 and 5. In the preferred embodiment of the method of this invention, the strands of the conductive roving are bound by a spirally wound overwrap, which is sufficient in many applications to reform the flattened ribbon into a cylindrical bundle. The breaker however has important advantages in the method of this invention, including the application of a false twist which closely packs the strands in the cylindrical bundle, as described. The breaker should however be considered optional in the overall method, although important to the method of this invention.

Figure 13:
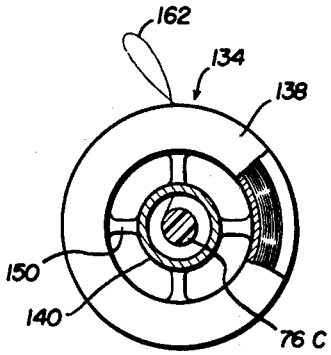
FIG. 13 is a cross-sectional view of FIG. 12 in the direction of view arrows 13—13.
Figure 12:
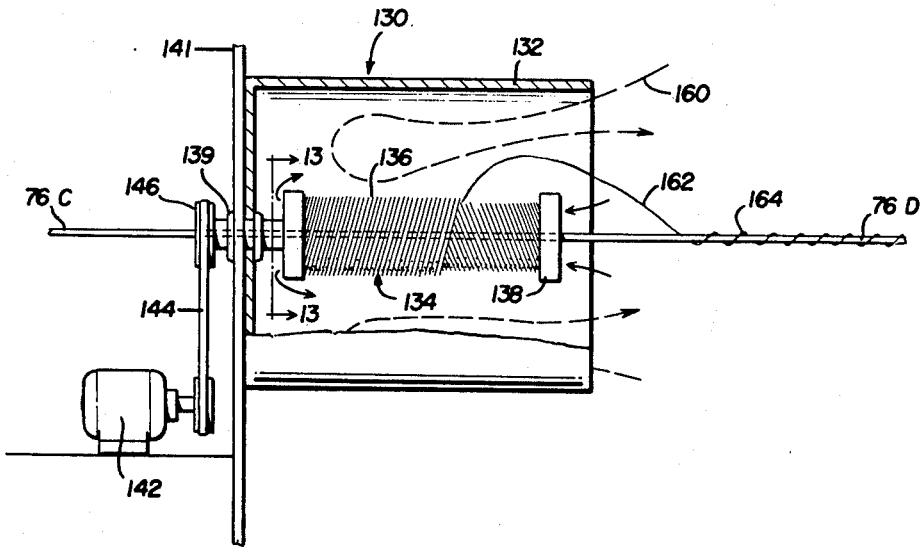
FIG. 12 is a side elevation, partially cross-sectioned of an overwrap winding station.

FIGS. 12 and 13 illustrate one method of applying the overwrap which binds the conductive strands into a cylindrical roving, which forms the conductive core of the electrical conductor of this invention. Alternative methods will be disclosed in the description of FIGS. 21 to 23. In the overwrap winding station 130, shown in FIGS. 12 and 13, the conductive roving bundle 76C is received in a stationary hood or shroud 132. The hood shown in FIG. 12 is cup-shaped and prevents transient air currents from disturbing the winding operation described below. In certain applications therefore the preferred hood may be eliminated. Inside the hood is a rotating bobbin or spool 134 having yarn or a strand of a non-conductive fiber 136 wound thereon. A suitable yarn would be a continuous twisted strand of fiber glass, such as E Glass described above. The bobbin includes opposed rims 138 which retains the yarn on the bobbin and the bobbin is secured to a hollow drive shaft or spindle 140 for rotation therewith. The drive shaft is connected through a suitable bearing 139 in support 141 to motor 142 by belt 144 and pulleys 146.

In the disclosed embodiment, the bobbin 134 is hollow as shown in FIG. 13, wherein the rims 138 are connected to the drive shaft 140 by a plurality of fins 150. The fins 150 may generate further air currents in the hood 132 and aid in the control of the ballooning yarn 162 as will now be described. The rotating bobbin generates air currents indicated by the arrow 160 which enters the hood, circulates over the bobbin and lifts the ballooning yarn as shown. The conductive roving 76C is pulled through the axial bore 140 of the bobbin and the yarn is wound under tension on the roving, as shown in 164 in FIG. 12. As described, the bobbin is rotating at a sufficient speed to throw the yarn centrifugally, preferably in an unconfined balloon 162 having its free end adhered to the roving. The centrifugal force of the balloon is thus used to wind the yarn on the roving under sufficient tension to bind the roving into a cylindrical form. In the disclosed embodiment the fins 150 may further generate air currents which pass through the bobbin and direct the currents within the hood 132 as shown. The yarn in this embodiment of the overwrap station may be further given a twist as it unwinds from the bobbin and is spirally wound under tension on the conductive roving. The twist will depend upon the rotational speed of the bobbin and the speed of the line. In another application of the method of this invention, the yarn is wound on the roving prior to receipt in the bobbin, as will be described in regard to FIG. 23. In the method disclosed in FIG. 1, the electrical resistance of the overwrapped conductive roving 76D is then continuously monitored to control the curing of the electrically conductive surface, such as by the apparatus disclosed in FIGS. 14 and 15.

Figure 14:
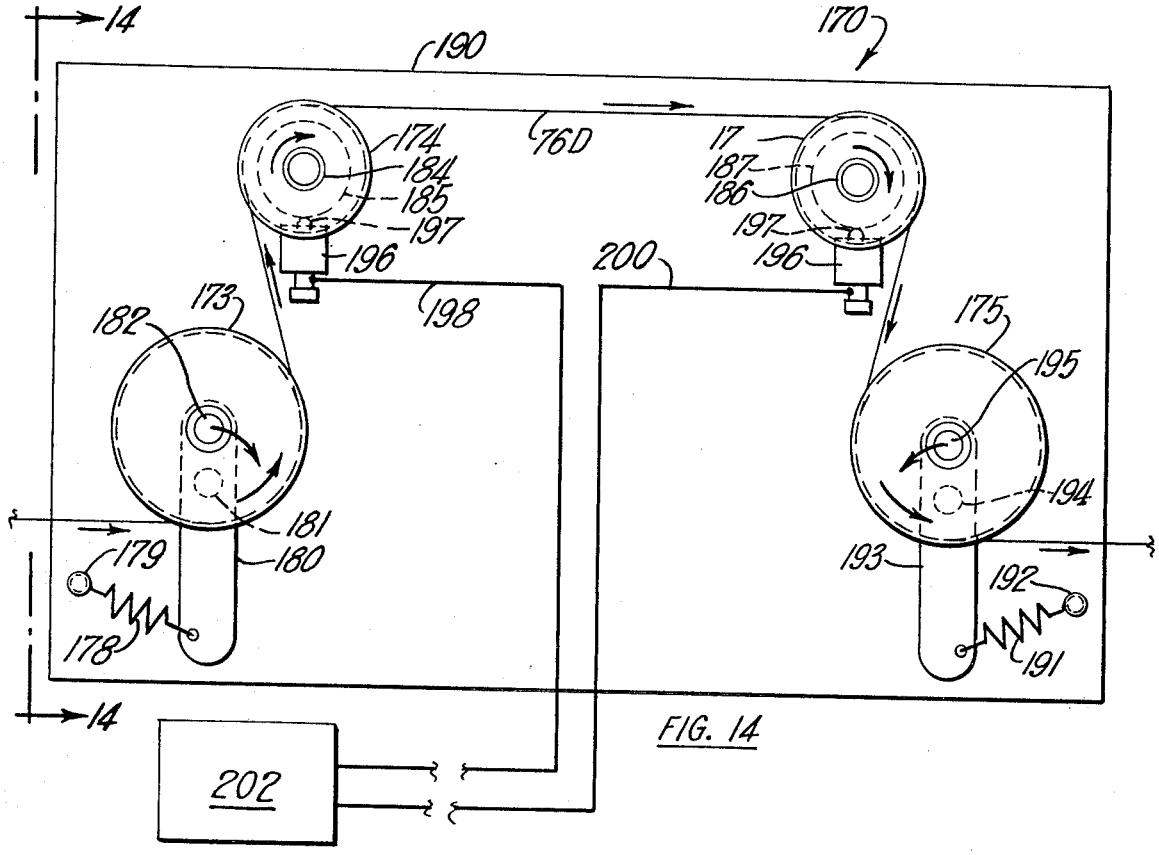
FIG. 14 is a side elevation, partially schematic, of a resistance monitoring station.
Figure 15:
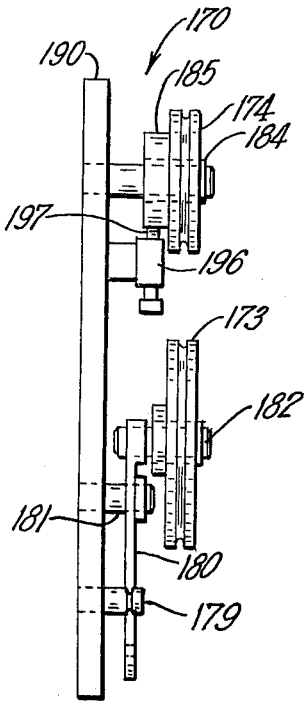
FIG. 15 is a partial end view of FIG. 14.

A suitable resistance monitoring station 170 is shown in FIG. 14, wherein the conductive roving 76D is directly in line with the overwrap winding station or set up as a separate station including feed drum. It will be understood that the preferred operation of this invention is continuous.

The resistance monitoring station 170 includes an entrance guide 173, a first contact roller 174, a second contact roller 176 and an exit guide 175.

The entrance guide 173 and exit guide 175 control the tension in the conductive roving 76D between the contact rollers to a standard or desired level for more accurate measurement of the resistance. As shown in FIG. 14 the entrance guide 173 is rotatably mounted with a bushing 182 at one end of a lever arm 180. The lever arm 180 pivots about the bushing 181 that is fixed to the support 190 and is biased at a desired tension with a spring 178 that is fixed at an end 179 to the support and attached at other end to the lever arm 180. So, the conductive roving 76D moving across the entrance guide 173 is controllably tensioned and guided to the first contact roller 174. The entrance guide is preferably a grooved roller which freely rotates on the movable axis 182.

The exit guide means 175 is of generally a similar configuration as the entrance guide means 173. Preferably, a grooved roller 175 is rotatably mounted with bushing 195 at one end of lever arm 193. The lever arm pivots about the fixed bushing 194 and is biased with the spring 191 to control the tension in the conductive roving 76D. Thus, the movably biased guides 173 and 175 control the tension in the conductive roving between the contact rollers 174 and 176.

In this apparatus the conductive roving 76D moves from the movably mounted tension controlling guide 173 to a first rotatable contact member 174 that is on a fixed axis. The roving then moves to a second rotatable contact member 176 that is also on a fixed axis. The contact rollers 174 and 176, generally grooved rollers for better guiding, are rotatably mounted on the fixed bushings 184 and 186 respectively so that they rotate on fixed axes. The bushings 184 and 186 are fixed to the support 190. It is critical to the operation that the length of roving between the contact members be a constant length so that resistance of the roving can be accurately measured as will be explained below. If the contact rollers were movably mounted the length of roving between them would vary. Thus, it is important that the contact rollers are on fixed axes. It is also important to control the tension in the roving as explained above.

The contact rollers 174 and 176 are formed of a conductive material and each have in the disclosed embodiment an integral metal hub 185 and 187 respectively. The hubs thereby provide a direct electrical connection to the conductive roving 76D through rollers 174 and 176. Electrical connectors 196 are secured to the support 190 and include an electrical contact brush 197 which electrically contacts the integral hub of each roller. The connectors are connected by wires or cables 198 and 200 to a monitor 202 shown schematically in FIG. 14. The monitor includes a standard recording ohm meter, such as sold by Esterline-Angus Company, Model A601C. As will be understood by one skilled in the art, the recording ohm meter is then connected to limit control switches which in turn are connected through relays to the heater elements 92 shown in FIG. 4. A voltage is then impressed by electrical connector 196, through wire 198, to roller 174 and the resistance drop of the length of conductive roving 76D across the rollers is measured and recorded by the ohm meter of monitor 202. This is compared with a standard. As described above, if the resistance is above a predetermined maximum, the temperature of the drums 80 in FIGS. 4 and 5 is automatically increased, lowering the resistance of the conductive roving. If the measured resistance is lower than a predetermined minimum, the temperature is decreased, which will increase the resistance of the conductive roving. The temperature of the drums is controlled by the heating elements 92 which are electrical heating elements located within the drums as described above. When the temperature of the drums is to be increased, for example, a limit switch is closed, closing appropriate relays which actuates additional heating elements within the drums. The electrical control is available commercially.

If several readings of the resistance were desired there can be more than two contact members that rotate on fixed axes. For example, the conductive roving could pass over three or four similar contact members and so that two or three resistance readings could be made. Each reading could be used to control a separate part of the production operation as will be more fully explained below. For example with three readings, one reading could be used to control the temperature of the upper heating drum, one reading could be used to control the heating of the lower heating drum and the other reading could be used for monitoring the quality of the operation and triggering an alarm when the roving is out of desired specifications.

Thus, the controlling of the electrical resistance of the roving includes (1) thermally curing the conductive coating, as by winding the roving on the heated drums 80 in FIGS. 4 and 5, (2) continuously monitoring the resistance of the roving, as shown with the apparatus in FIG. 14 and (3) controlling the curing, as by continuously controlling the temperature of the drums. In the method disclosed above, the strands 46 are coated with a thermally curable dispersion of conductive particles, however as described above, the coating may be carbonizable, pyrolizable or caramelizable. With this apparatus for monitoring the resistance of the roving shown in FIG. 14, the spacing between the rollers 174 and 176 is exactly controlled by being on fixed axes, so that the resistance of a predetermined length of roving is continuously monitored. For example, the distance between the contacting points of the rollers may be accurately controlled to one foot, such that the resistance of a one foot length of conductive roving is continuously measured and compared to a predetermined resistance, which is the desired resistance of the electrical conductor. The disclosed apparatus for monitoring the resistance of the roving then includes (1) means for continuously conducting a current along a predetermined constant length of the thermally cured strands, (2) means for continuously measuring the voltage across the predetermined length and (3) means for continuously comparing the voltage drop with the desired voltage drop. Finally, the extent of curing of the strands is varied when the voltage drop varies from the standard or desired resistance by controlling the temperature of the drums. As described above, this is accomplished continuously and automatically by activating the heating elements 92 within the heat drums.

Figure 17:
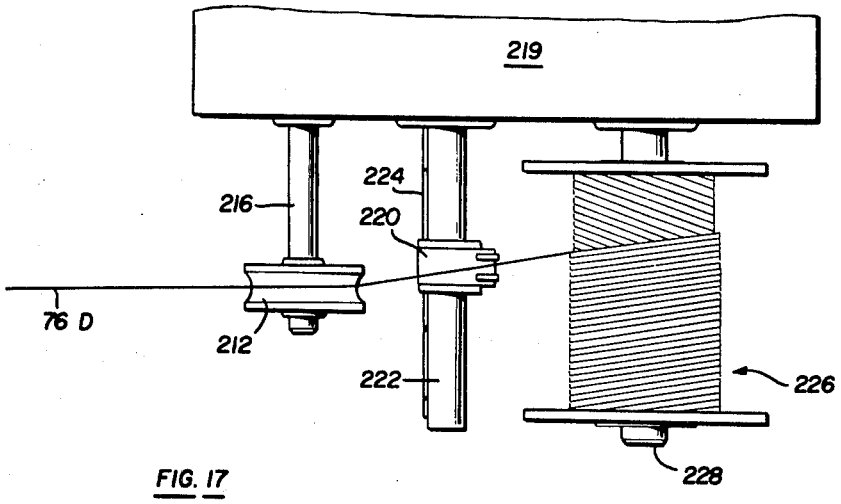
FIG. 17 is a top elevation of FIG. 16.
Figure 16:
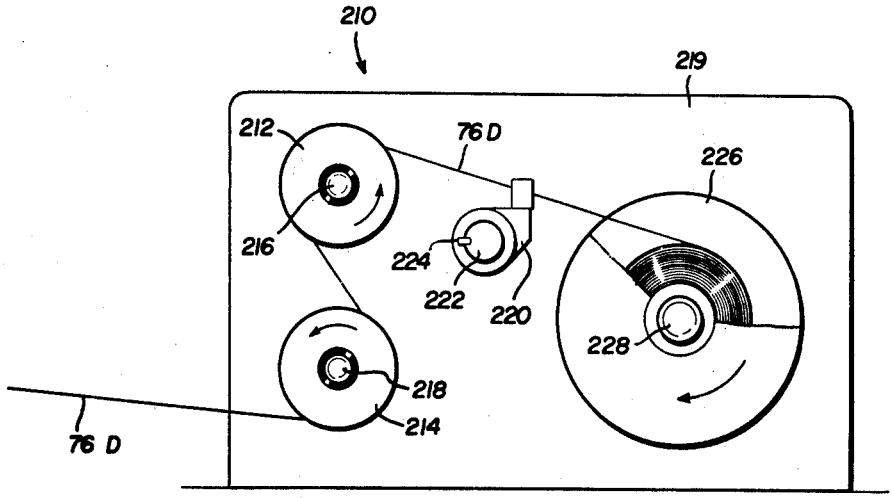
FIG. 16 is a side elevation of a winding station.

The electrically conductive roving may then be wound on a drum and stored for later use in the method of making an electrical conductor of this invention, or used in other applications. A suitable winding station 210 is shown in FIGS. 16 and 17. In the disclosed embodiment of the winding station, the conductive roving 76D is received around driven pulleys 212 and 214, providing a capstand type pulling action, tensioning the conductive roving. The pulleys are drivably mounted on drive shafts 216 and 218, respectively. The drive means including motors, pulleys, etc. are located within housing 219.

The conductive roving is then fed onto the take-up drum 266 through a conventional traverse 220 mounted on shaft 222 and guide 224. A suitable winding station is available from Davis Electric Company.

In the continuous method of this invention shown in FIG. 1, the winding station pulls the conductive roving against the tension of the drums 80 in FIGS. 4 and 5, providing a relatively high speed continuous process of making a conductive roving. Further, in the method disclosed in FIG. 1, a semi-conductive overcoat may then be applied by the method shown in FIGS. 18 to 20, as described below.

Figure 18:
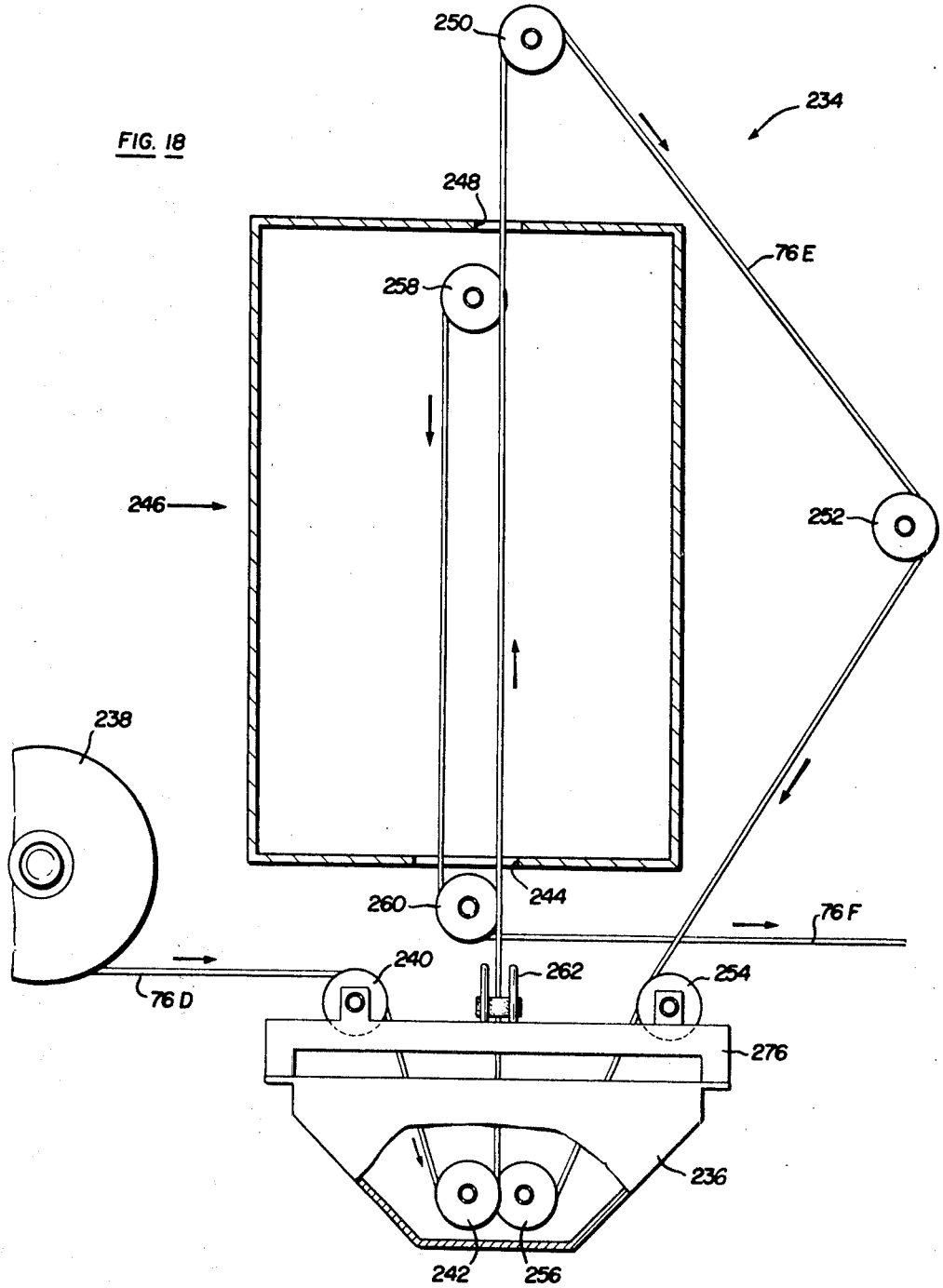
FIG. 18 is a side elevation, partially cross-sectioned of an overcoat dipping and curing station.

In the overcoat station 234 shown in FIGS. 18 and 19, the conductive roving 76D is received from a feed drum 238, over pulley 240 and into dip tank 236. In the preferred method of the invention, the tank 236 contains a liquid polymeric dispersion of conductive particles, such as more fully disclosed in U.S. Pat. No. 3,818,412 assigned to the Assignee herein. The semi-conductive material disclosed in such patent, which is incorporated herein by reference, comprises a suspension of fine conductive powders, preferably graphite or carbon, in polytetrafluoroethylene. Tetrafluoroethylene is available commercially from E. I. duPont de Nemours Company under the tradename "Teflon." The graphite carbon particles are added to the Teflon as a dispersion, which may also include a filler, such as a silicate, wetting agents, etc. A suitable graphite dispersion, for example, includes 100 parts by weight tetrafluoroethylene as received, 27.3 parts by weight graphite and 62.7 parts by weight water.

The conductive roving 76D is first impregnated with the semi-conductive fluid as shown in FIGS. 18 and 19 by dip pulley 242. The impregnated conductive roving 76E is the partially cured in furnace 246. The roving enters the furnace through opening 244 and leaves the furnace through exit 248. The partially cured roving is cooled in this embodiment of the method outside the furnace, being received around pulleys 250, 252 and 254. The impregnated roving is then dipped in the tank 236 around dip pulley 256 and cured in furnace 246. In the disclosed embodiment, the overcoated roving 76F is disposed around pulley 258 located within the furnace and out of the furnace, around pulley 260. The semi-conductive overcoat is thus fully cured within the furnace.

In the disclosed embodiment of the dip tank 236, wiping and sizing dies 262 and 264 receive the conductive roving as it leaves the tank. Details of the sizing die 262 are shown in FIG. 20, which includes an annular die member 266 and a wire frame 268. The die member 266 is loosely received on the conductive roving and normally rests upon the spaced parallel lower frame fingers or arms 272. When an agglomeration of fluid collects on the roving, the die member will lift from the lower arms to engage the resilient upper arms 272, removing the accumulation of fluid from the roving and simultaneously sizing the coating. The diameter of the die opening 274 will depend upon the particular application. For example, in the embodiment of the electrical conductor disclosed above, a suitable die opening for the first die is 0.060 inches, wherein the roving has been impregnated with the semi-conductive overcoat material. The second die would then be 0.065 inches, which sizes the overcoat.

The electrical conductor 280 in FIG. 21, formed by the method of this invention as described above, then includes an electrically conductive roving 282 comprising a plurality of conductive strands, a spiral overwrap 284 of a non-conductive yarn or strand and preferably a semi-conductive overcoat 286. As described in the above referenced patent, the overwrap 284 is preferably a distinct winding or windings, rather than a braid, which provides uniform spacing between the windings. The spacing is accurately controlled and the overwrap is wound under tension, such as a tension of 50 grams, to secure the conductive roving in a uniform cylindrical bundle. The electrical conductor formed by the method of this invention has a uniform cross-section and the overwrap provides a uniform conductance between the roving 282 and the semi-conductive overcoat 286. In the preferred method of forming the overcoat 286, the roving is first impregnated with the semi-conductive material, filling the non-conductive spaces between the non-conductive yarn and the individual strands of the roving 282. Finally, a uniform layer or overcoat 286 is formed over the impregnated roving providing the preferred uniform conductance between the semi-conductive overcoat and the conductive roving. This is particularly important where a uniform resistance is to be obtained in the electrical conductor, which is a primary object of the method of this invention.

In the method disclosed in FIG. 1, the resistance of the semi-conductive overcoat 286 is monitored continuously in a monitoring station, such as shown at 170 in FIG. 14. In the second monitoring station however the monitor 202 is a recording ohm meter and the resistance is compared with an acceptable standard. Where the resistance is too high, the weight percent of conductive particles is increased in the dip tank 236, reducing the overcoat resistance to the desired value. Where the resistance is too low, the weight percent of the binder is increased. Finally, the electrical conductor formed by the method of this invention may be wound on a drum at a second winding station, which may be similar to the winding station shown at 210 in FIGS. 16 and 17.

Figure 22:
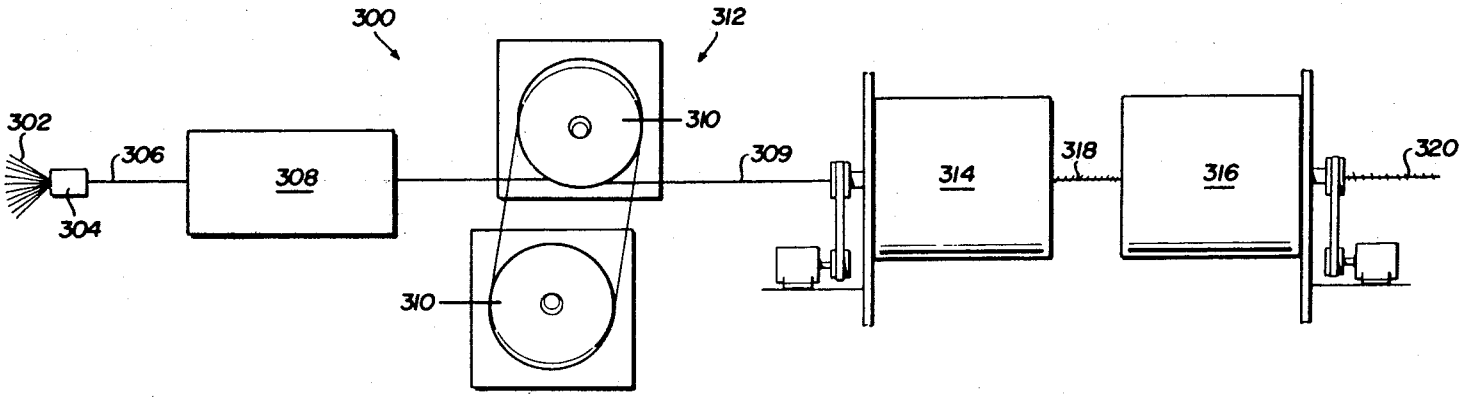
FIG. 22 is a partially schematic side elevation of another embodiment of the method of this invention.

FIG. 22 illustrates an alternative method of forming a conductive roving. Some of the apparatus may be identical to the apparatus previously described, as set forth below. In the method shown in FIG. 22, the strands 302 are collected in an eye 304 to form a plurality of strands 306, as described in regard to FIGS. 2 and 3. The strands are then dipped in a thermally curable liquid dispersion of conductive particles at dipping station 308 and collected in a single roving or core as described above. The roving is then cured at curing station 312 on rotating drums 310 as described above in regard to FIGS. 4 and 5. The roving 309 now has been flattened into a ribbon as shown at 76B in FIG. 6. In this embodiment of the method, the breaking station has been eliminated and the conductive roving is reformed into a cylindrical roving or core in the overwrap winding stations 314 and 316.

As described above, the overwrap is wound on the roving under tension and may be utilized to reform the roving into a cylindrical core. In this embodiment of the method, two non-interwoven windings are used to securely retain the conductive roving in a cylindrical bundle of uniform cross-section. 318 designates the roving with a single winding and 320 designates the roving with a double winding.

Figure 23:
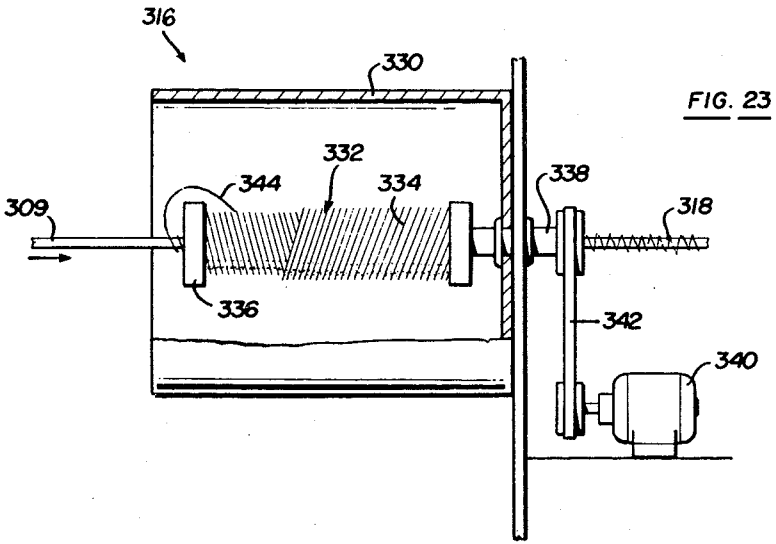
FIG. 23 is a side elevation, partially cross-sectioned, of another embodiment of an overwrap winding station.

The second winding station 316 differs from the winding station disclosed in FIGS. 12 and 13 in that the yarn or strand is wound on the roving prior to receipt in the spindle, as more clearly shown in FIG. 23. The overwrap winder includes a hood or shroud 330 and a rotating hollow bobbin 332 located within the hood. The bobbin includes the overwrap yarn 334 and rims 336. The bobbin is preferably hollow as described above and the rims 336 may include fins as shown at 150 in FIG. 13. The bobbin is supported on a shaft or hub 338 which is connected to a motor by belt 342. The details of the winding station may therefore be the same as shown in FIGS. 12 and 13 except as described.

The direction of travel of the conductive roving 309 has been reversed in FIG. 23. The roving enters the open end of the shroud 330 and the yarn is thrown in a balloon 334 to spirally wind on the conductive roving prior to entering the bobbin 332. By this method, the overwrap winding and tension may be more accurately controlled, making a tighter bundle and a rounder product. Also, the bobbin is self-cleaning. The speed of the line and rpm of the bobbin may also be increased, for example from 8100 to 12,000 rpm, providing 4 to 6 turns per inch of conductive roving. Further, the tension is more uniform, which is particularly important in providing a roving having uniform resistance, as described above.

The remainder of the method may be the same as described above. The resistance of the conductive roving may be continuously monitored on a resistance monitoring station, such as shown at 170 in FIG. 14, permitting the continuous adjustment of the resistance of the roving by controlling the temperature of the drums during the forming operation. Finally, the conductive roving may be coated with a semi-conductive overcoat in the coating and curing station shown at 234 in FIGS. 18 and 19. The conductive roving formed by this method is shown in FIG. 24.

Figure 24:
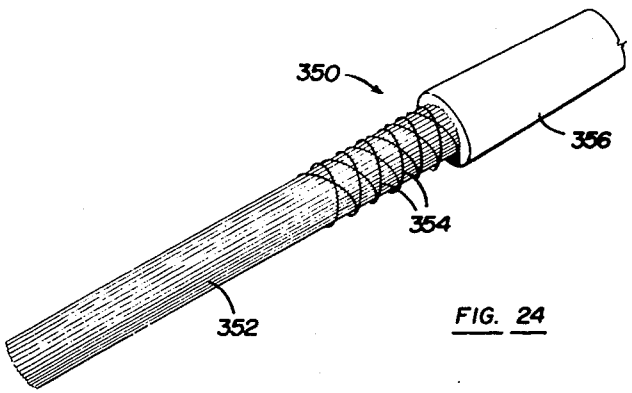
FIG. 24 is a top perspective view of another embodiment of an electrical conductor formed by the method of this invention.

The conductor shown in FIG. 24 includes a conductive roving or core 352 comprising a bundle of conductive strands of glass fibers. The strands are uniformly and tightly secured by two non-interlacing spiral windings 354 and the overwrap is covered with a semi-conductive overcoat 356.

As described in the above referenced United States patent assigned to the Assignee herein, the overwrap includes two distinct winding layers, rather than a braid, which is easier to strip and provides more uniform spacing between the windings. The spacing is preferably controlled to between 1/16 to 3/16 inches, measured between cross-over points, which, in combination with the semi-conductive overcoat, provides uniform conductance between the overcoat and the core.

The steps of the method of this invention may therefore be modified and combined to provide a continuous process for making an electrical conductor. Further, the method of this invention produces an electrical conductor having uniform resistance within relatively narrow limits. For example, an electrical conductor having a resistance of 4,000 ± 500 ohms per foot may be formed by the method of this invention, which is particularly important in many applications of the electrical conductor.

Having described the invention in detail and with reference to specific particulars, it will be understood such specifications are given for the sake of explanation, and various modifications and substitutions other than those cited may be made without departing from the scope of the invention as defined in the following claims.

1. Apparatus for controlling the electrical resistance in a moving electrical conductor during its production, the conductor being a bundle of continuous filaments coated with a thermally curable liquid dispersion of conductive particles, the electrical resistance of the conductor being determined by the degree of thermal curing of the coating comprising:

a. a first rotatable contact member on a fixed axis position such that the moving conductor contacts the member;

b. means before the first member for controlling the tension in the conductor moving to the first member;

c. a second rotatable contact member on a fixed axis, the second member being spaced from the first member such that the moving conductor contacts the second member after leaving the first member, the first and second members being on fixed axes so that the length of moving conductor between the members is kept at a constant length;

d. means for supplying current to the moving conductor at the first member to conduct a current along the constant length of conductor between the member;

e. means for measuring the voltage drop across the constant length of conductor and comparing that voltage drop with a standard voltage drop;

f. means for varying the resistance of the conductor by varying the extent of thermal curing of the coating when the voltage drop measured varies from the standard.

2. The apparatus of claim 1 wherein the means before the first member for controlling the tension includes a movably mounted roller guide that is biased to control the tension at a desired level.

3. Apparatus for sensing the electrical resistance in traveling conductive linear material to control the resistance in the linear material at a desired level comprising:

a. a movably mounted entrance guide means to receive the conductive material and to compensate for changes in tension in the conductive material to keep the tension at a constant amount;

b. a first rotatable contact member on a fixed axis spaced from the entrance guide such that the conductive material leaving the entrance guide contacts the first member;

c. a second rotatable contact member on a fixed axis, the second member being spaced from the first member such that the conductive material leaving the first member contacts the second member so that the length of conductive material between the members is kept at a constant length;

d. means for supplying electrical current to the conductive material at the first contact member to conduct a current along the constant length of conductive material between the members;

e. means for measuring the voltage drop across the constant length of material between the members;

f. means for comparing the voltage drop measured with a desired voltage drop;

g. means for varying the resistance in the linear material when the voltage drop varies from that desired; and h. a movably mounted exit guide means to receive the conductive material from the second contact member and to compensate for changes in tension in the conductive material to keep the tension at a constant amount.

4. The apparatus of claim 3 wherein the first contact member is electrically conductive and the electrical current is supplied to the conductive material through the first member.

5. The apparatus of claim 3 wherein the entrance guide means and the exit guide means each include a biased, movably mounted roller guide.

6. Apparatus for controlling the electrical resistance in a moving electrical conductor during its production, the conductor being a bundle of glass filaments coated with a thermally curable liquid dispersion of conductive particles, the electrical resistance of the conductor being determined by the extent of thermal curing of coated filaments comprising:

a. an entrance guide means for receiving the conductor after thermal curing of the coating, the guide being movably mounted so that it automatically moves when the tension in the conductor varies from a desired amount to control the tension in the conductor at the desired amount;

b. a first rotatable contact member on a fixed axis spaced from the entrance guide such that the moving conductor contacts the member after leaving the entrance guide;

c. a second rotatable contact member on a fixed axis, the second member being spaced from the first member such that the moving conductor contacts the second member after leaving the first member, the first and second members being on fixed axes so that the length of moving conductor between the members is kept at a constant length;

d. means for continuously supplying electrical current to the moving conductor at the first member to continuously conduct a current along the constant length of the conductor between the members;

e. means for continuously measuring the voltage drop across the constant length of conductor between the members;

f. means for continuously comparing the voltage drop in the constant length of conductor with a desired voltage drop; and g. means for varying the extent of thermal curing of the coated filaments when the voltage drop varies from that desired.

7. The apparatus of claim 6 including an exit guide means spaced from the second member which receives the moving conductor after it leaves the second member, the guide being movably mounted so that it automatically moves when the tension in the conductor varies from a desired amount to control the tension at the desired amount.

8. The apparatus of claim 7 wherein the first contact member is an electrically conductive grooved roller guide and the electrical current is supplied to the conductor through the first member.

9. The apparatus of claim 7 wherein the entrance guide means and the exit guide means each include a movably mounted grooved roller guide that is controllably biased with a spring.

* * * * *